US011529548B2

(12) United States Patent
Woods

(10) Patent No.: US 11,529,548 B2
(45) Date of Patent: Dec. 20, 2022

(54) COMBINATION EXERCISE ASSEMBLY AND METHOD OF USE

(71) Applicant: Maxwell Woods, Shawnee, KS (US)

(72) Inventor: Maxwell Woods, Shawnee, KS (US)

( * ) Notice: Subject to any disclaimer, the term of this patent is extended or adjusted under 35 U.S.C. 154(b) by 57 days.

(21) Appl. No.: 17/235,593

(22) Filed: Apr. 20, 2021

(65) Prior Publication Data

US 2022/0331656 A1 Oct. 20, 2022

(51) Int. Cl.

| | |
|---|---|
| ***A63B 23/035*** | (2006.01) |
| ***A63B 21/062*** | (2006.01) |
| ***A63B 21/00*** | (2006.01) |
| ***A63B 22/06*** | (2006.01) |
| ***A63B 21/22*** | (2006.01) |

(52) U.S. Cl.

CPC .. *A63B 23/03575* (2013.01); *A63B 21/00069* (2013.01); *A63B 21/063* (2015.10); *A63B 21/154* (2013.01); *A63B 21/225* (2013.01); *A63B 21/4035* (2015.10); *A63B 22/0605* (2013.01); *A63B 2225/093* (2013.01)

(58) Field of Classification Search

CPC .... A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 22/04; A63B 22/06; A63B 22/0605; A63B 22/0664; A63B 21/225; A63B 21/15; A63B 21/151; A63B 21/152; A63B 21/153; A63B 21/154; A63B 21/155; A63B 21/156; A63B 21/157; A63B 21/158; A63B 21/159; A63B 21/078; A63B 21/0783; A63B 21/22; A63B 21/222; A63B 21/227; A63B 23/03575

USPC ..... 482/62

See application file for complete search history.

(56) References Cited

U.S. PATENT DOCUMENTS

| | | | | |
|---|---|---|---|---|
| 2,675,236 A * | 4/1954 | Blickman | A63B 21/06 | 482/102 |
| 3,734,495 A * | 5/1973 | Nist | A63B 23/0405 | 482/137 |
| 3,743,282 A * | 7/1973 | Zinkin | A63B 23/0417 | 482/99 |
| 4,149,714 A * | 4/1979 | Lambert, Jr. | A63B 21/155 | 482/137 |
| 4,200,279 A * | 4/1980 | Lambert, Jr. | A63B 21/06 | 482/137 |

(Continued)

FOREIGN PATENT DOCUMENTS

| | | |
|---|---|---|
| WO | WO9009815 | 9/1990 |

*Primary Examiner* — Jennifer Robertson
*Assistant Examiner* — Thao N Do

(57) ABSTRACT

A combination exercise assembly for performing aerobic and strength training exercises includes a base, which can be positioned on a substantially horizontal surface. A stationary bicycle is engaged to the base so that a user positioned on a seat of the stationary bicycle faces a first end of the base. A lat pulldown machine engaged to the base proximate to a second end of the base is positioned for engagement by the user positioned on the seat of the stationary bicycle. The stationary bicycle is pedaled to perform aerobic exercise and the lat pulldown machine resists a pulldown motion to perform strength training exercises.

9 Claims, 7 Drawing Sheets

(56) References Cited

U.S. PATENT DOCUMENTS 4,240,626 A * 12/1980 Lambert, Jr. ..... A63B 21/155 482/137
4,311,305 A * 1/1982 Lambert, Jr. ..... A63B 23/00 482/137
4,322,071 A * 3/1982 Lambert, Jr. ..... A63B 21/155 482/100
4,373,717 A * 2/1983 Lambert, Jr. ..... A63B 21/06 482/45
4,511,137 A * 4/1985 Jones ..... A63B 21/00181 482/142
5,080,351 A * 1/1992 Rockwell ..... A63B 21/0628 482/138
5,236,406 A * 8/1993 Webber ..... A63B 21/4047 482/99
5,580,341 A * 12/1996 Simonson ..... A63B 23/03525 482/136
5,643,145 A * 7/1997 Lo ..... A63B 21/068 482/57
5,971,895 A * 10/1999 Habing ..... A63B 21/4035 482/137
6,071,216 A * 6/2000 Giannelli ..... A63B 21/4035 482/136
6,976,941 B2 * 12/2005 Britt ..... A63B 23/1209 482/102
20,090,124 5/2009 Pinto
7,708,670 B2 5/2010 Bowser
7,981,010 B1 * 7/2011 Webber ..... A63B 21/159 482/137
7,993,251 B1 * 8/2011 Webber ..... A63B 21/159 482/137
D785,107 S 4/2017 Moschel
2003/0158019 A1 * 8/2003 Giannelli ..... A63B 21/155 482/100
2004/0018920 A1 * 1/2004 Simonson ..... A63B 21/156 482/99
2005/0032611 A1 * 2/2005 Webber ..... A63B 23/1209 482/97
2006/0019804 A1 * 1/2006 Young ..... A63B 22/0605 482/57
2006/0035755 A1 * 2/2006 Dalebout ..... A63B 24/00 482/52
2007/0207902 A1 * 9/2007 Tiahrt ..... A63B 21/155 482/101
2008/0039296 A1 * 2/2008 Steinmetz ..... A63B 23/03583 482/100
2008/0242520 A1 * 10/2008 Hubbard ..... A63B 21/0628 482/98
2009/0149302 A1 * 6/2009 Thuma ..... A63B 21/0628 482/99
2010/0004099 A1 * 1/2010 Fey ..... A63B 21/00181 2/102
2010/0035729 A1 * 2/2010 Pandozy ..... A63B 21/068 482/148
2010/0041520 A1 * 2/2010 Popescu ..... A63B 23/1209 482/37
2010/0285933 A1 * 11/2010 Nalley ..... A63B 21/063 482/94
2010/0285935 A1 * 11/2010 Barnett ..... A63B 21/0628 482/99
2012/0108400 A1 * 5/2012 DeMeo ..... A63B 21/0783 482/92
2012/0277070 A1 * 11/2012 Sienna ..... A63B 21/06 482/94
2013/0237385 A1 * 9/2013 Sun ..... A63B 22/0046 482/57
2014/0364282 A1 * 12/2014 Moschel ..... A63B 21/4047 482/80
2014/0364283 A1 * 12/2014 Moschel ..... A63B 23/1209 482/142
2014/0364284 A1 * 12/2014 Moschel ..... A63B 22/0002 482/97
2016/0074698 A1 * 3/2016 Figueroa ..... A47C 17/38 5/2.1
2018/0085617 A1 * 3/2018 Adom ..... A61H 1/0237
2019/0070463 A1 * 3/2019 Romero ..... A63B 21/0724
2019/0126090 A1 * 5/2019 O'Connor ..... A63B 21/155
2019/0262654 A1 * 8/2019 Giannelli ..... A63B 23/1209
2019/0336816 A1 * 11/2019 Moschel ..... A63B 23/0476
2020/0188726 A1 * 6/2020 Carter ..... A63B 21/068
2020/0353310 A1 * 11/2020 Bissonnette ..... A63B 22/0005
2020/0376327 A1 * 12/2020 Bissonnette ..... A63B 22/0605
2021/0113877 A1 * 4/2021 Chin ..... A63B 21/154
2022/0331656 A1 * 10/2022 Woods ..... A63B 21/063

* cited by examiner

COMBINATION EXERCISE ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise assemblies and more particularly pertains to a new exercise assembly for performing aerobic and strength training exercises. The present invention discloses an exercise assembly comprising a stationary bicycle combined with a lat pulldown machine having a selectable weight system.

(2) Description of Related Art Including Information Disclosed Under 37 CFR 1.97 and 1.98

The prior art relates to exercise assemblies. Prior art exercise assemblies may comprise stationary bicycles combined with rowing machines, spring resisters, pullup bars, and inclined weight benches. What is lacking in the prior art is an exercise assembly comprising a stationary bicycle combined with a lat pulldown machine having a selectable weight system.

BRIEF SUMMARY OF THE INVENTION

An embodiment of the disclosure meets the needs presented above by generally comprising a base, which is configured to be positioned on a substantially horizontal surface. A stationary bicycle is engaged to the base so that a user positioned on a seat of the stationary bicycle faces a first end of the base. A lat pulldown machine engaged to the base proximate to a second end of the base is positioned for engagement by the user positioned on the seat of the stationary bicycle. The stationary bicycle is configured to be pedaled to perform aerobic exercise and the lat pulldown machine is configured to resist a pulldown motion to perform strength training exercises.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
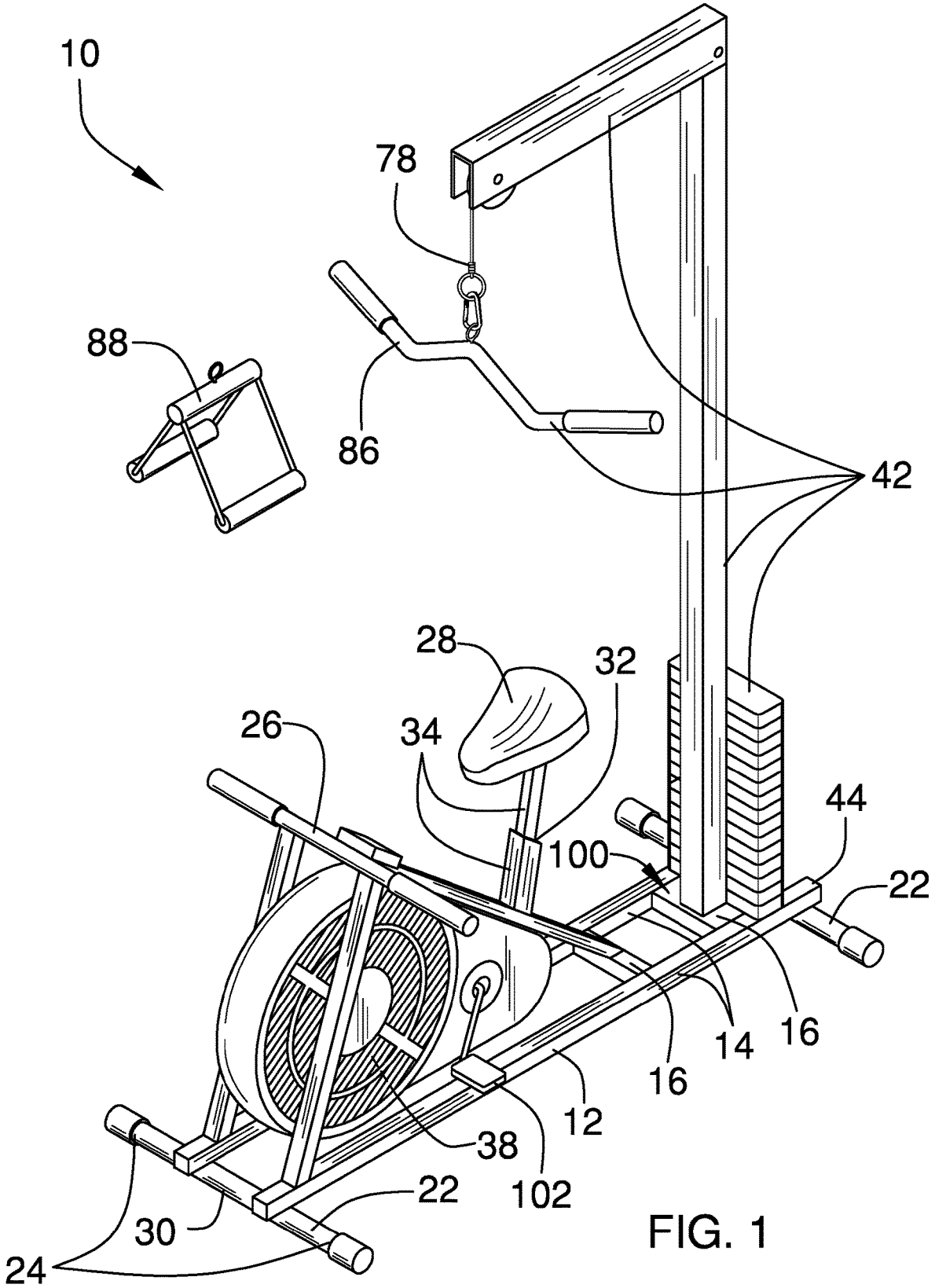
FIG. 1 is an isometric perspective view of a combination exercise assembly according to an embodiment of the disclosure.
Figure 2:
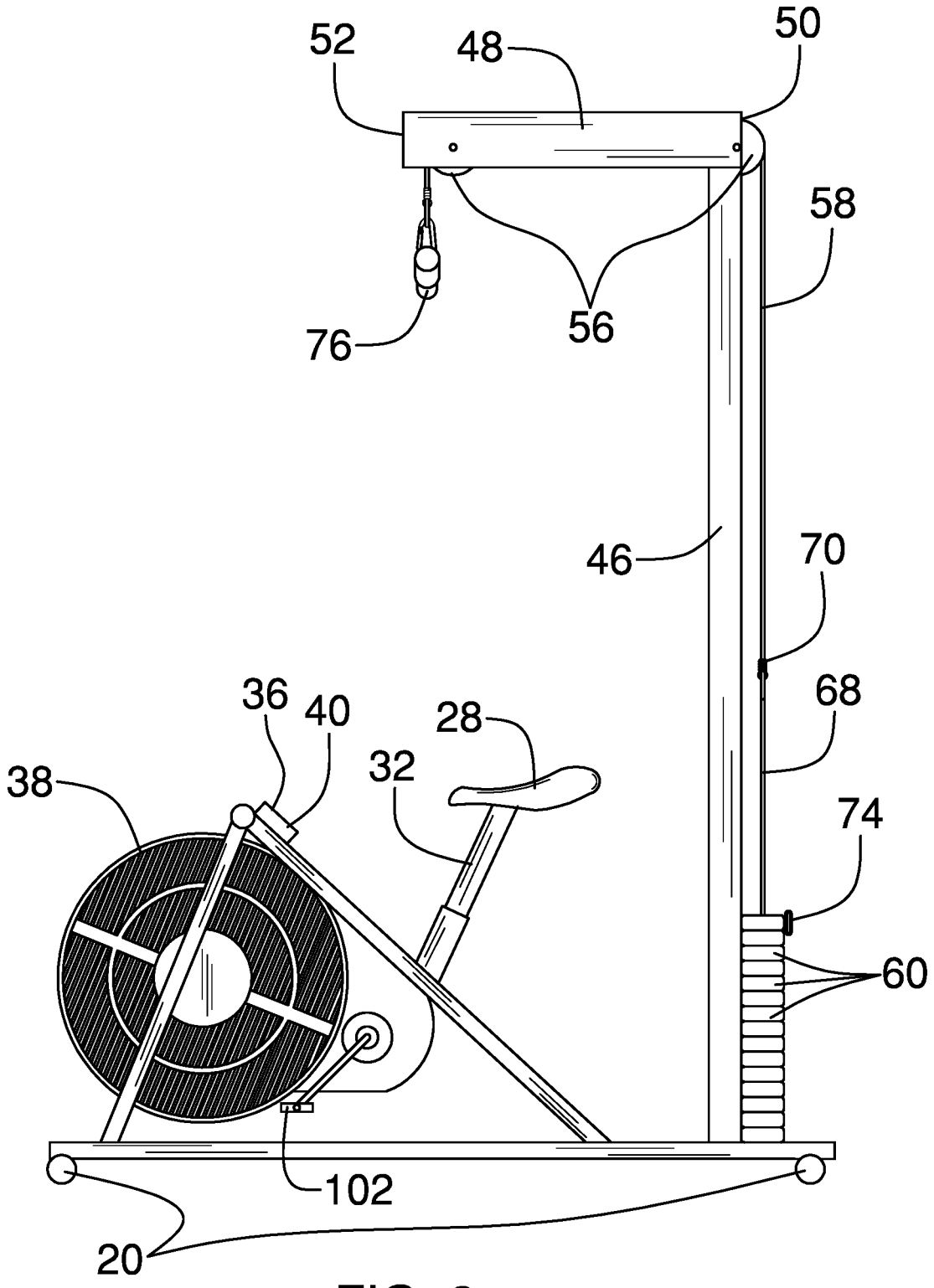
FIG. 2 is a side view of an embodiment of the disclosure.
Figure 3:
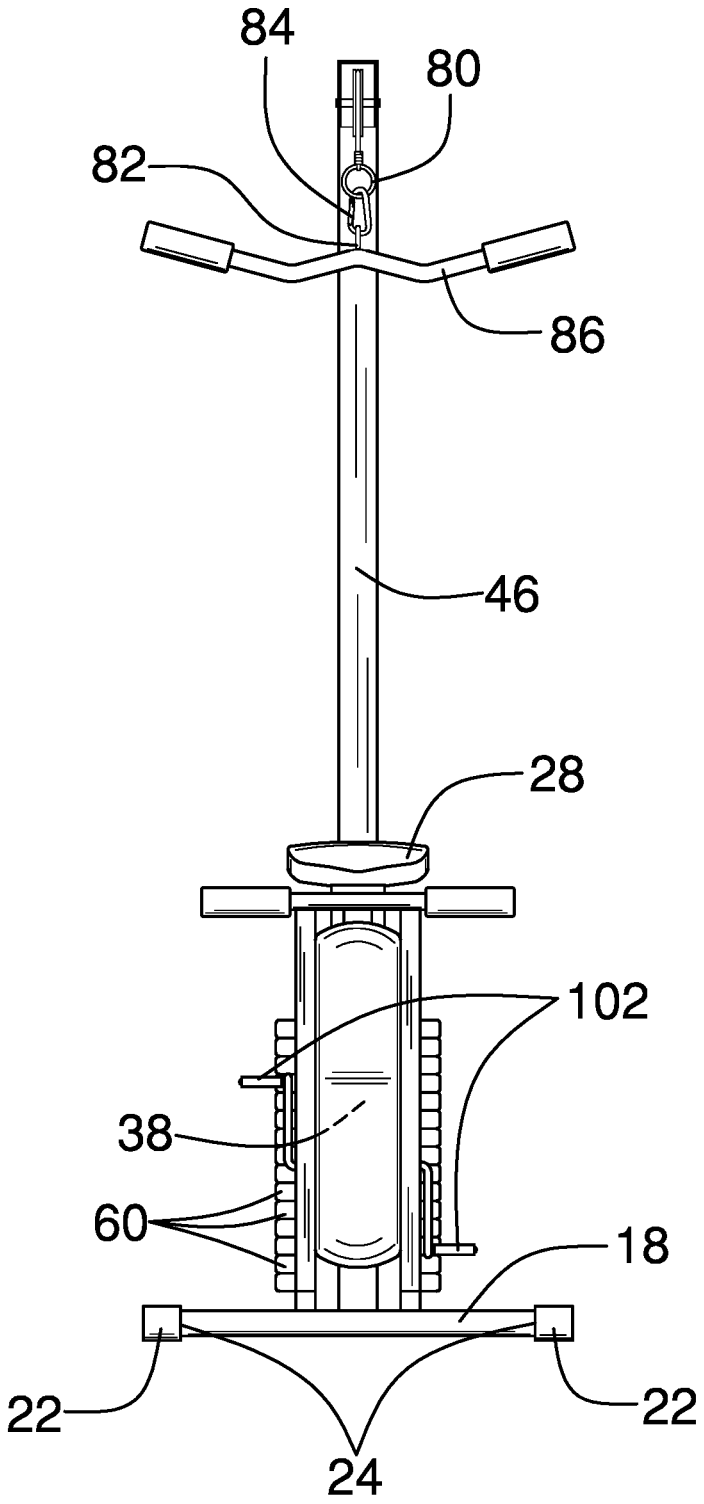
FIG. 3 is a front view of an embodiment of the disclosure.
Figure 4:
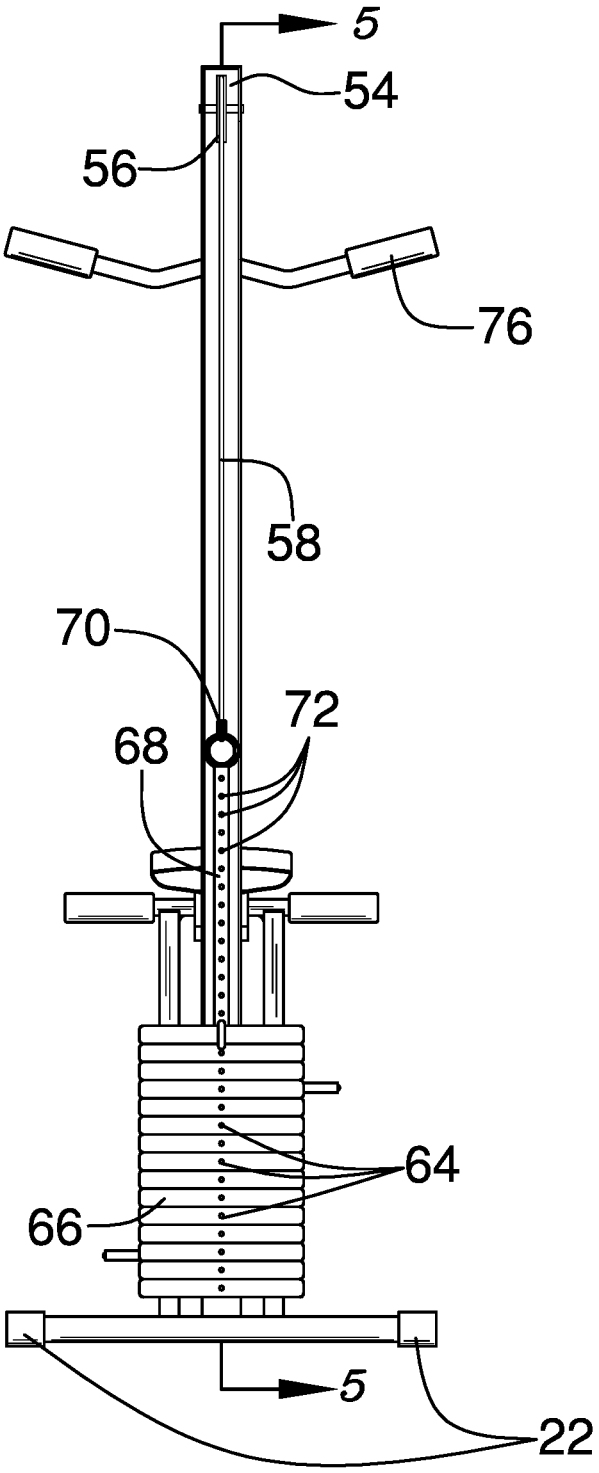
FIG. 4 is a rear view of an embodiment of the disclosure.

With reference now to the drawings, and in particular to FIGS. 1 through 7 thereof, a new exercise assembly embodying the principles and concepts of an embodiment of the disclosure and generally designated by the reference numeral 10 will be described.

As best illustrated in FIGS. 1 through 7, the combination exercise assembly 10 generally comprises a base 12, which is configured to be positioned on a substantially horizontal surface. The base 12 comprises a pair of first bars 14, a set of crossbars 16, and a pair of end bars 18. Each crossbar 16 is engaged to and extends between the first bars 14 so that the first bars 14 are parallelly positioned. Each end bar 18 is engaged to and extends bidirectionally from a respective opposed end 20 of the pair of first bars 14. The end bars 18 are configured to deterring tilting of the pair of first bars 14 relative to the substantially horizontal surface. Each of a set of feet 22 is engaged to a respective opposed terminus 24 of a respective end bar 18 so that each opposed terminus 24 of each end bar 18 has a foot 22 engaged thereto. The feet 24 are configured to stabilize the base 12 on the substantially horizontal surface.

Figure 6:
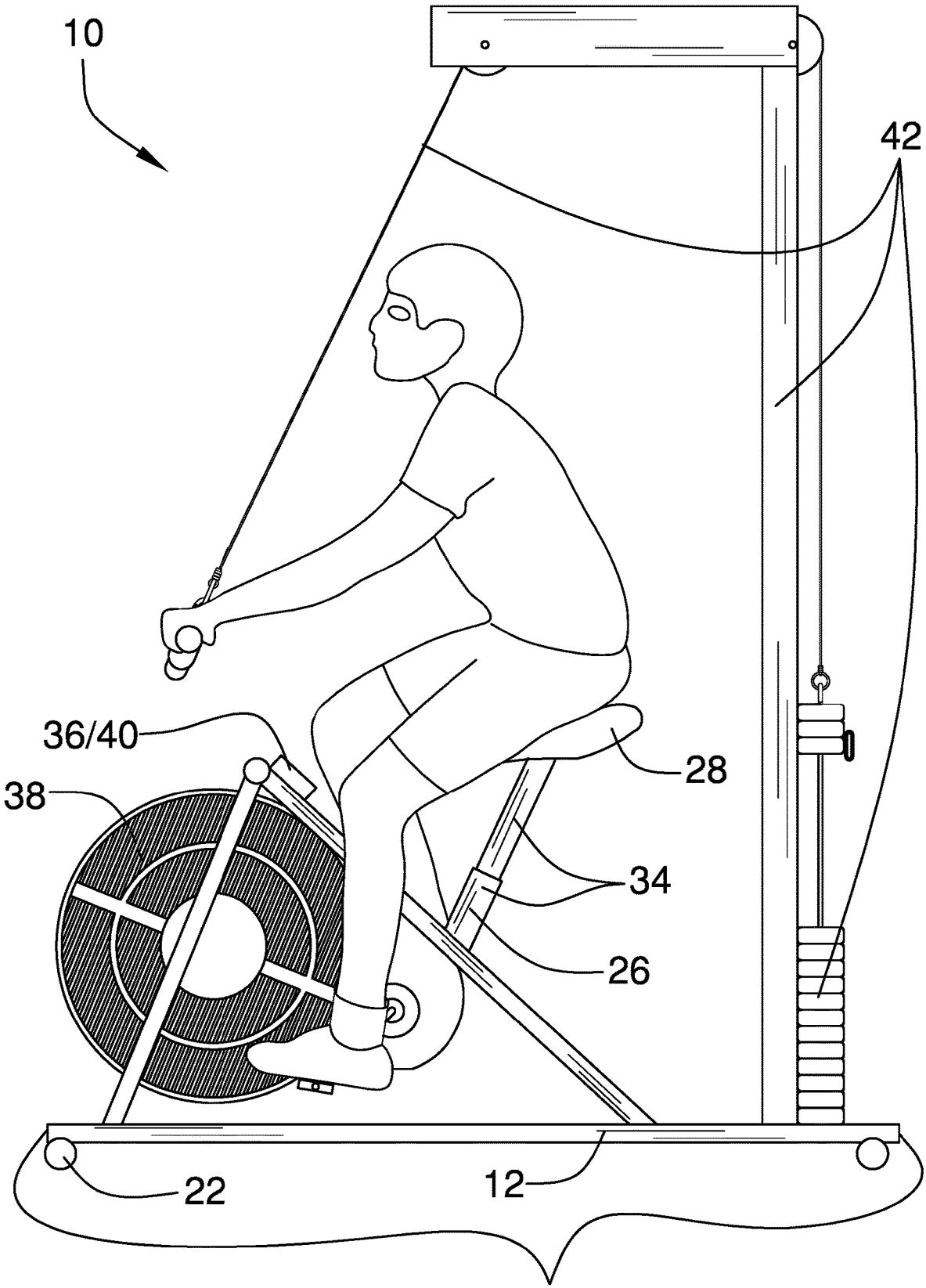
FIG. 6 is an in-use view of an embodiment of the disclosure.
Figure 7:
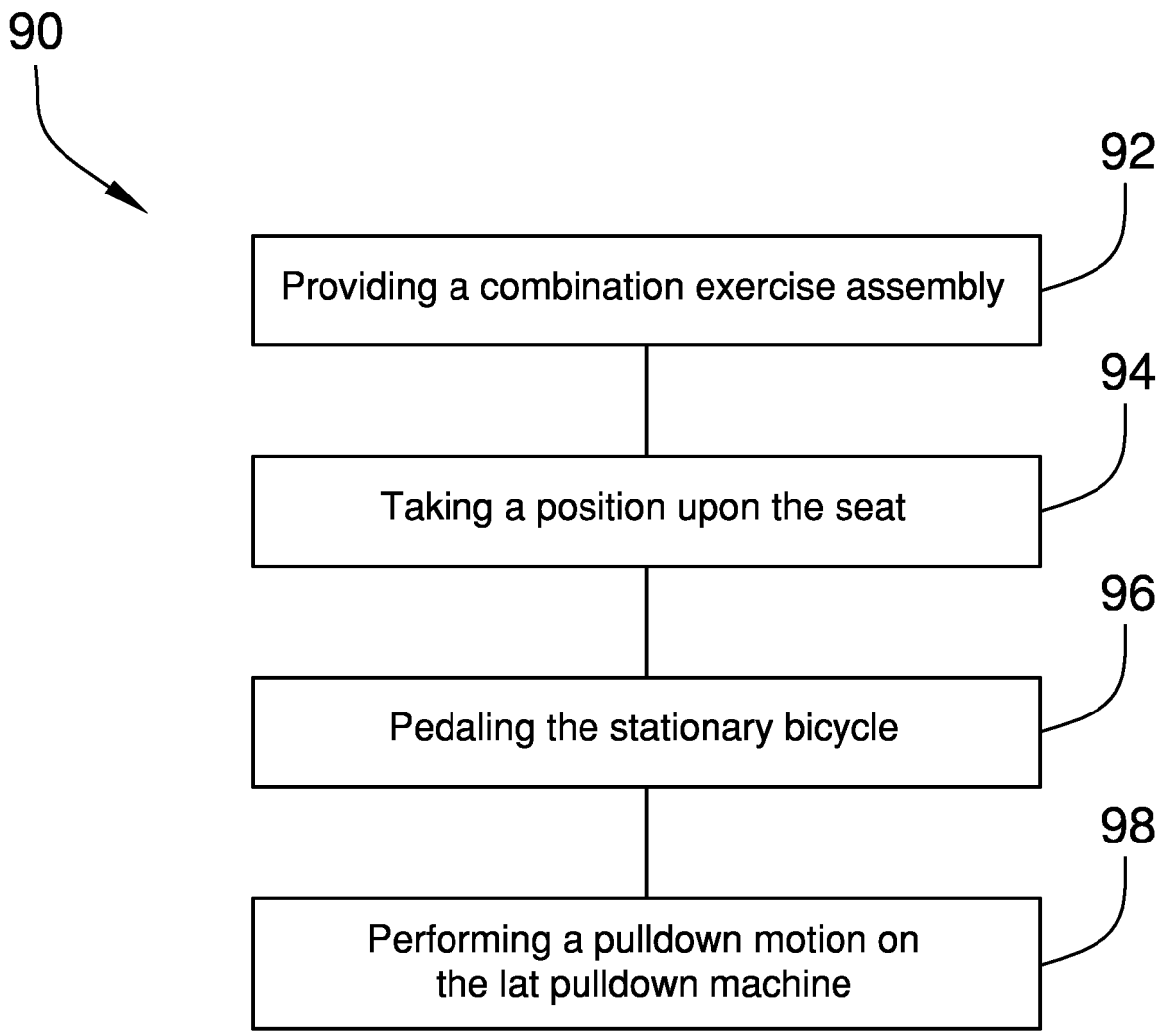
FIG. 7 is flow diagram for a method utilizing an embodiment of the disclosure.

A stationary bicycle 26 is engaged to the base 12 so that a user positioned on a seat 28 of the stationary bicycle 26 faces a first end 30 of the base 12, as shown in FIG. 6. The seat 28 is engaged to a post 32, which comprises a pair of nested sections 34 so that the seat 28 is selectively height adjustable. The present invention also anticipates the stationary bicycle 26 being rotated 180° so the user is facing a second end 44 of the base.

A controller 36 engaged to the stationary bicycle 26 is configured to adjust a resistance upon a flywheel 38 of the stationary bicycle 26 so that an amount of energy required to be applied to pedals 102 of the stationary bicycle 26 is selectively adjustable. A timer 40 engaged to the stationary bicycle 26 is configured to display an operation time of the stationary bicycle 26.

A lat pulldown machine 42 engaged to the base 12 proximate to the second end 44 of the base 12 is positioned for engagement by the user positioned on the seat 28 of the stationary bicycle 26. The stationary bicycle 26 is configured to be pedaled to perform aerobic exercise and the lat pulldown machine 42 is configured to resist a pulldown motion to perform strength training exercises.

The lat pulldown machine 42 comprises a brace 100 defined by one of the crossbars 16, which is engaged to and which extends between the first bars 14. A vertical member 46 is engaged to and extends perpendicularly from the brace 100. A horizontal member 48 is engaged by a first terminus 50 to and extends from the vertical member 46 distal from the brace 100 so that a second terminus 52 of the horizontal member 48 is positioned approximately above the seat 28. The horizontal member 48 defines a channel 54.

A pair of pulleys 56 is engaged to the horizontal member 48 and is positioned singly in the channel 54 proximate to the first terminus 50 and the second terminus 52. A cable 58 is operationally engaged to the pair of pulleys 56.

The lat pulldown machine 42 also comprises a plurality of plates 60. Each of a plurality of first holes 62 extends axially through a respective plate 60. Each of a plurality of second holes 64 extends bidirectionally into a respective plate 60 from the first hole 62 positioned in the respective plate 60 and opens to at least one opposed edge 66 of the respective plate 60.

Figure 5:
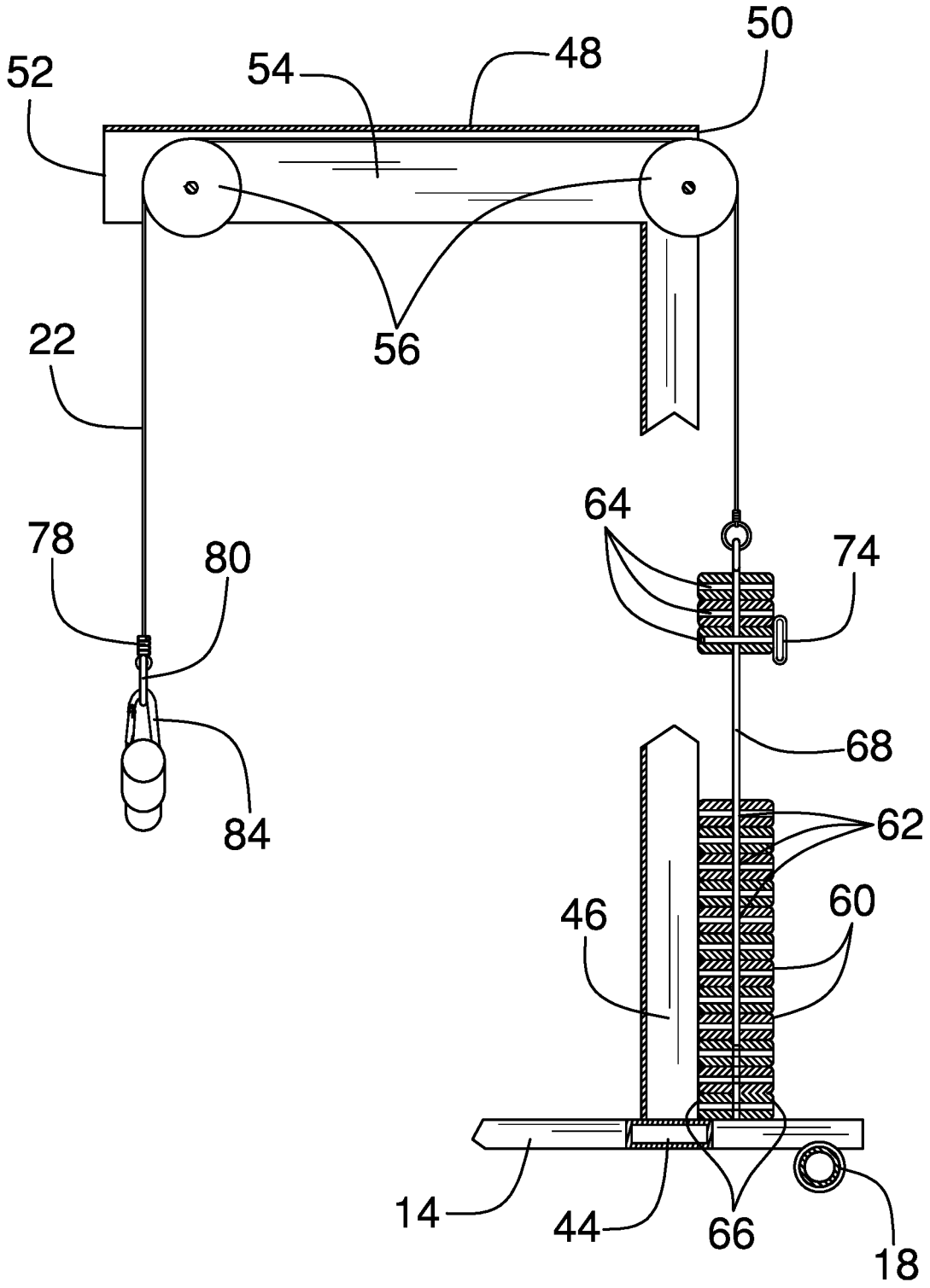
FIG. 5 is a cross-sectional view of an embodiment of the disclosure.

A tube 68 engaged to a first endpoint 70 of the cable 58 is selectively insertable into the plurality of first holes 62, as shown in FIG. 5. A plurality of third holes 72 is positioned in the tube 68 so that a respective third hole 72 is selectively alignable with a second hole 64 positioned in a respective plate 60. A pin 74 is selectively insertable into the respective third hole 72 and the second hole 64 so that the respective plate 60, and plates 60 positioned above the respective plate 60, are engaged to the cable 58. The plurality of plates 60 enables a weight selection of from 2.5 to 115.0 kilograms by selection of respective plates 60 from the plurality of plates 60.

A handle 76 is engaged to a second endpoint 78 of the cable 58. The handle 76 is configured to be grasped in one or both hands of the user so that the user is positioned to pull down on the handle 76 to lift the plates 60.

A first ring 80 is engaged to the second endpoint 78 of the cable 58. A second ring 82 is engaged to the handle 76. A clip 84 is selectively engageable to the first ring 80 and the second ring 82 to removably engage the handle 76 to the cable 58. The handle 76 is one of a set of handles 76. As shown in FIG. 1, the set of handles 76 comprises a first handgrip 86, which is W-shaped, and a second handgrip 88, which is V-shaped.

In use, the combination exercise assembly 10 enables a method of performing aerobic and strength training exercises 90. The method 90 comprises a first step 92 of providing a combination exercise assembly according to the specification above. A second step 94 of the method 90 entails the user taking a position upon the seat 28. A third step 96 of the method 90 entails the user pedaling the stationary bicycle 26 to get aerobic exercise. A fourth step 98 of the method 90 entails the user performing a pulldown motion on the lat pulldown machine 42 to get strength training exercises. Ideally, the user would perform the third step 96 and the fourth step 98 simultaneously.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combination exercise assembly comprising:

a base configured for positioning on a horizontal surface;

a stationary bicycle engaged to the base, such that a user positioned on a seat of the stationary bicycle faces a first end of the base;

a lat pulldown machine engaged to the base proximate to a second end of the base, such that the lat pulldown machine is positioned for engagement by the user positioned on the seat of the stationary bicycle, wherein the stationary bicycle is configured for pedaling for performing aerobic exercise and the lat pulldown machine is configured resisting a pulldown motion for performing strength training exercises; and wherein the base comprises:

a pair of first bars;

a set of crossbars, each crossbar being engaged to and extending between the pair of first bars, such that the pair of first bars is parallelly positioned; and a pair of end bars, each end bar being engaged to and extending bidirectionally from a respective opposed end of the pair of first bars, wherein the pair of end bars are configured for deterring tilting of the pair of first bars relative to the horizontal surface.

2. The combination exercise assembly of claim 1, wherein the lat pulldown machine comprises:

a brace engaged to and extending between the pair of first bars;

a vertical member engaged to and extending perpendicularly from the brace;

a horizontal member engaged by a first terminus to and extending from the vertical member distal from the brace, such that a second terminus of the horizontal member is positioned above the seat, the horizontal member defining a channel;

a pair of pulleys engaged to the horizontal member and being positioned in the channel singly proximate to the first terminus and the second terminus, a cable operationally engaged to the pair of pulleys;

a plurality of plates;

a plurality of first holes, each first hole extending axially through a respective plate;

a plurality of second holes, each second hole extending bidirectionally into the respective plate from the first hole positioned in the respective plate and opening to at least one opposed edge of the respective plate;

a tube engaged to a first endpoint of the cable and being selectively insertable into the plurality of first holes;

a plurality of third holes positioned in the tube, such that a respective third hole is selectively alignable with a second hole positioned in the respective plate;

a pin selectively insertable into the respective third hole and the second hole, such that the respective plate and the plurality of plates positioned above the respective plate are engaged to the cable; and a handle engaged to a second endpoint of the cable, wherein the handle is configured for grasping in One or both hands of the user, positioning the user for pulling down on the handle for lifting the plurality of plates.

3. The combination exercise assembly of claim 2, wherein the plurality of plates enables a weight selection of from 2.5 to 115.0 kilograms by selection of respective plates from the plurality of plates.

4. The combination exercise assembly of claim 2, further including:

a first ring engaged to the second endpoint of the cable;

a second ring engaged to the handle;

a clip selectively engageable to the first ring and the second ring for removably engaging the handle to the cable; and the handle being one of a set of handles comprising a first handgrip and a second handgrip, the first handgrip being W-shaped, the second handgrip being V-shaped.

5. The combination exercise assembly of claim 1, further including a set of feet, each foot being engaged to a respective opposed terminus of a respective end bar, such that each opposed terminus of each end bar has the foot engaged thereto, wherein the set of feet are configured for stabilizing the base on the horizontal surface.

6. The combination exercise assembly of claim 1, wherein the seat is engaged to a post, the post comprising a pair of nested sections, such that the seat is selectively height adjustable.

7. The combination exercise assembly of claim 1, further including a controller engaged to the stationary bicycle and being configured for adjusting a resistance upon a flywheel of the stationary bicycle, such that an amount of energy required to be applied to pedals of the stationary bicycle is selectively adjustable.

8. The combination exercise assembly of claim 1, further including a timer engaged to the stationary bicycle and being configured for displaying an operation time of the stationary bicycle.

9. A combination exercise assembly comprising:

a base configured for positioning on a horizontal surface, the base comprising:

a pair of first bars, a set of crossbars, each crossbar being engaged to and extending between the pair of first bars, such that the pair of first bars is parallelly positioned, and a pair of end bars, each end bar being engaged to and extending bidirectionally from a respective opposed end of the pair of first bars, wherein the pair of end bars are configured for deterring tilting of the pair of first bars relative to the horizontal surface;

a set of feet, each foot being engaged to a respective opposed terminus of the respective end bar, such that each opposed terminus of each end bar has the foot engaged thereto, wherein the feet are configured for stabilizing the base on the horizontal surface;

a stationary bicycle engaged to the base, such that a user positioned on a seat of the stationary bicycle faces a first end of the base, the seat being engaged to a post, the post comprising a pair of nested sections, such that the seat is selectively height adjustable;

a controller engaged to the stationary bicycle and being configured for adjusting a resistance upon a flywheel of the stationary bicycle, such that an amount of energy required to be applied to pedals of the stationary bicycle is selectively adjustable;

a timer engaged to the stationary bicycle and being configured for displaying an operation time of the stationary bicycle; and a lat pulldown machine engaged to the base proximate to a second end of the base, such that the lat pulldown machine is positioned tier engagement by the user positioned on the seat of the stationary bicycle, wherein the stationary bicycle is configured for pedaling for performing aerobic exercise and the tat pulldown machine is configured resisting a pulldown motion for performing strength training exercises, the lat pulldown machine comprising:

a brace engaged to and extending between the pair of first bars, a vertical member engaged to and extending perpendicularly from the brace, a horizontal member engaged by a first terminus to and extending from the vertical member distal from the brace, such that a second terminus of the horizontal member is positioned approximately above the seat, the horizontal member defining a channel, a pair of pulleys engaged to the horizontal member and being positioned in the channel singly proximate to the first terminus and the second terminus, a cable operationally engaged to the pair of pulleys, a plurality of plates, a plurality of first holes, each first hole extending axially through a respective plate, a plurality of second holes, each second hole extending bidirectionally into the respective plate from the first hole positioned in the respective plate and opening to at least one opposed edge of the respective plate, a tube engaged to a first endpoint of the cable and being selectively insertable into the plurality of first holes, a plurality of third holes positioned in the tube, such that a respective third hole is selectively alignable with a second hole positioned in the respective plate, a pin selectively insertable into the respective third hole and the second hole, such that the respective plate and the plurality of plates positioned above the respective plate are engaged to the cable, the plurality of plates enabling a weight selection of from 2.5 to 115.0 kilograms by selection of respective plates from the plurality of plates, a handle engaged to a second endpoint of the cable, wherein the handle is configured for grasping in one or both hands of the user, positioning the user for pulling down on the handle for lifting the plurality of plates, a first ring engaged to the second endpoint of the cable, a second ring engaged to the handle, a clip selectively engageable to the first ring and the second ring for removably engaging the handle to the cable, and the handle being one of a set of handles comprising a first handgrip and a second handgrip, the first handgrip being W-shaped, the second handgrip being V-shaped.

* * * * *